United States Patent [19]

Vessichelli

[11] 4,444,084

[45] Apr. 24, 1984

[54] ADJUSTABLE TENSIONING AND LOCKING DEVICE

[76] Inventor: Lucien Vessichelli, 108 Deerfield Rd., West Caldwell, N.J. 07006

[21] Appl. No.: 449,538

[22] Filed: Dec. 13, 1982

[51] Int. Cl.[3] ..... D04C 3/18

[52] U.S. Cl. ..... 87/57; 87/21; 242/147 R; 242/156

[58] Field of Search ..... 87/21, 22, 55–57, 87/61; 242/147 R, 153, 156

[56] References Cited

U.S. PATENT DOCUMENTS

| | | | |
|---|---|---|---|
| 3,324,757 | 6/1967 | Richardson | 87/57 |
| 3,817,147 | 6/1974 | Richardson | 87/57 |
| 4,375,279 | 3/1983 | Koch | 242/156 |

*Primary Examiner*—John Petrakes

*Attorney, Agent, or Firm*—Weingram & Klauber

[57] ABSTRACT

A cylindrical tensioning device fits over a fixed shaft against a rotatable bobbin containing a supply of wire such as used in a wire braiding machine. The device includes an outer tensioning section cylinder enclosing a spring supported between two bushings. A fixed bushing at one end holds an external friction pad which engages the end of the bobbin to apply a force that controls the tension on the wire drawn from the bobbin. A locking section at the other end includes a smaller outer cylinder enclosing another spring around an inner cylinder. The spring is held between an end of the outer cylinder and a ridge on the inner cylinder. The other end of the inner cylinder includes holes holding ball bearings which are slidable along the shaft. A wedged ring fits over the inner cylinder and bearings. The other end of the smaller outer cylinder is press fit within the other bushing which is movable within the larger outer cylinder against the first spring. When the locking section cylinder is moved along the shaft into the tensioning cylinder, the first spring is forced against the end bushing and friction pad while the inner cylinder causes the ball bearings to engage the wedged ring and lock in position along the shaft. The locking section spring holds the elements in place and is released by pushing the inner cylinder in the reverse direction. The adjustable position on the shaft thus determines the force applied against the end of the bobbin and controls the tension in the wire.

7 Claims, 4 Drawing Figures

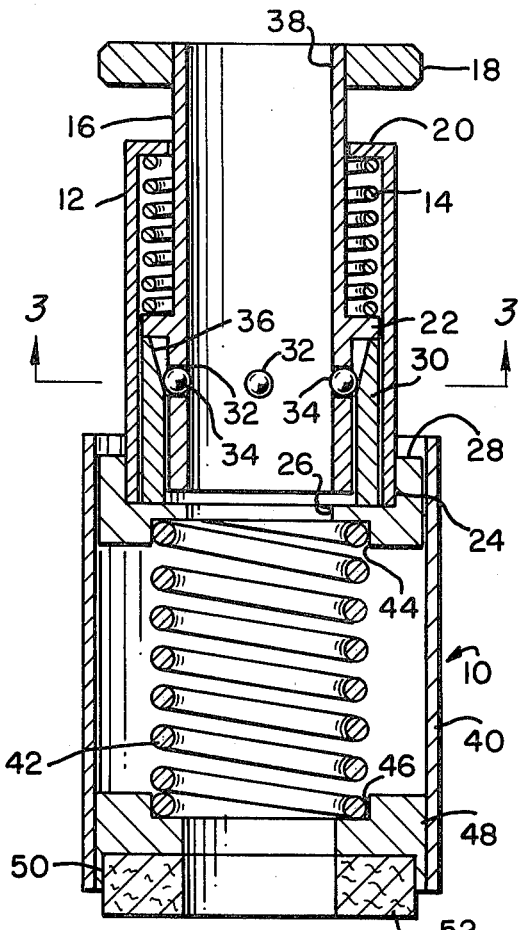
FIG. 2
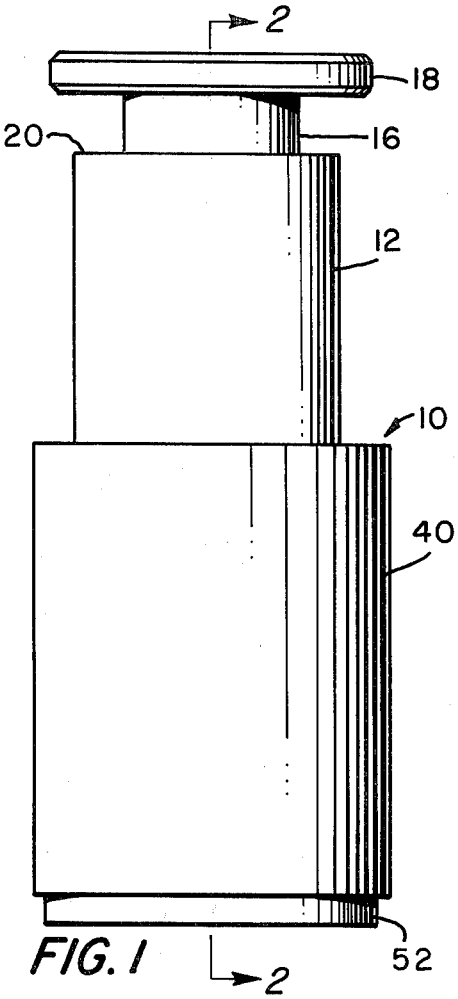
FIG. 1
FIG. 3
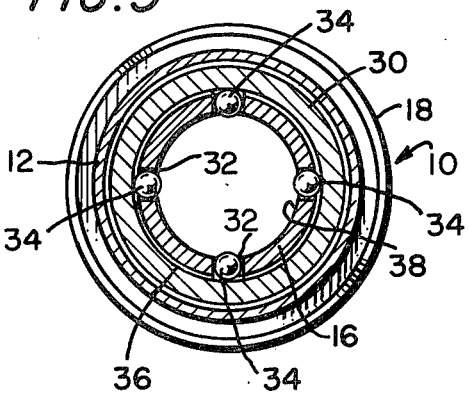
FIG. 4
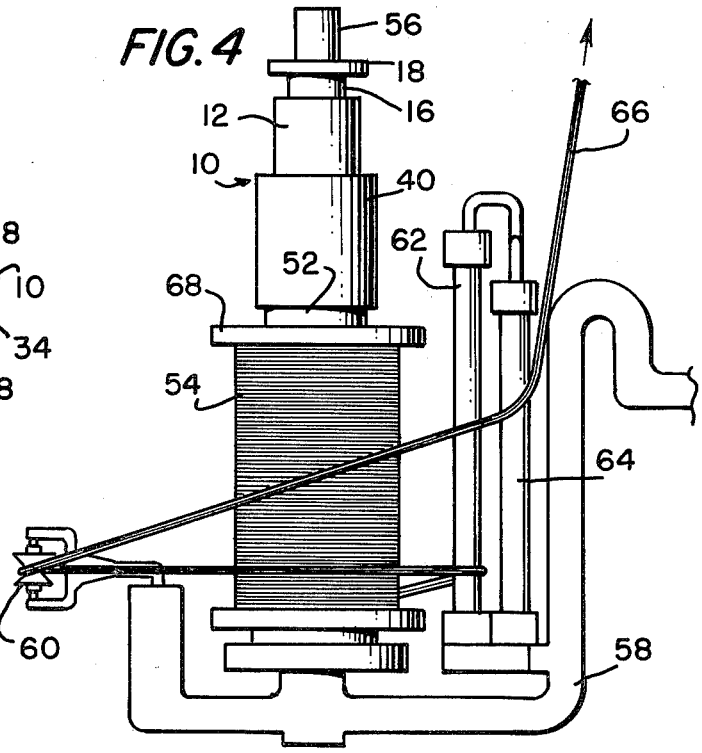

ADJUSTABLE TENSIONING AND LOCKING DEVICE

BACKGROUND OF THE INVENTION

1. Field of the Invention

The present invention relates to apparatus for controlling tension on devices for feeding strands of wire-like material and particularly to an improved device for applying an adjustable friction force against a wire supply bobbin and for locking the device in position to maintain the desired tension.

2. Description of the Prior Art

Present wire feeding devices used in multi-filament wire braiding machines have complex mechanisms for adjusting the tension on wire fed from supply bobbins. These usually employ ratchet and spring mechanisms which are cumbersome, costly and difficult to adjust and maintain at a desired tension. Another device for adjusting tension and friction on a bobbin supplying textile thread material uses an adjustable collar on a shaft to control spring tension on a friction disc, such as shown in U.S. Pat. No. 1,364,259. This device requires excessive manipulation with two hands and is subject to loosening. A further device, such as shown in U.S. Pat. No. 2,232,966, utilizes a tubular member to retain a tensioning spring on a shaft with a threaded follower adjusting the force on a friction element engaging a film reel. The shaft rotates with the reel and a screw locks the follower on the shaft to maintain the desired tension and friction. This device likewise requires much manipulation and frequent tightening. Other devices are known utilizing hollow cylinders with an internal wedge for locking elements in a desired position on a shaft, but these could not be used for adjusting tension in a rotating mechanism.

SUMMARY OF THE INVENTION

It is therefore the primary object of the present invention to provide an improved adjustable tensioning device which is simple, easy to manipulate with only one hand and which locks firmly onto a shaft to maintain a desired tension.

This is achieved with a cylindrical device that fits over a fixed shaft carrying a rotatable bobbin having a supply of wire wound thereon. A first outer cylinder of a tensioning section encloses a first spring held by two end bushings mounted on the shaft. One end bushing is fixed to the cylinder and includes an external recess holding a friction pad to engage and apply a force against an end of the bobbin to control the tension on the wire drawn from the bobbin. A second smaller outer cylinder of a locking section at the other end encloses a second spring mounted around an inner cylinder over the shaft. The second spring is held between the outer end of the second cylinder and a ridge on the inner cylinder. The portion of the inner cylinder on the other side of the ridge includes holes holding ball bearings slidable along the shaft. A wedged ring fits around the inner cylinder and bearings. The inner end of the second cylinder is press fit into the second end bushing holding the inner end of the first spring. The second bushing fits and is movable within the inner end of the first outer cylinder against the inner end of the first spring. When the locking section second outer cylinder is moved along the shaft into the first cylinder, the second bushing compresses the first spring and applies force against the first bushing and friction pad. The inner cylinder also moves into the second outer cylinder and wedged ring which engages the ball bearings and causes the bearings to lock in position on the shaft. The second spring holds the locking section in this position until released by pushing the inner cylinder in the opposite direction. The tension on the first spring and against the bobbin are thus adjustable by the position at which the locking section engages the shaft. Other objects and advantages will become apparent from the following description in conjunction with the accompanying drawings.

BRIEF DESCRIPTION OF THE DRAWINGS

FIG. 1 is a side view of the adjustable tensioning and locking device of the present invention, FIG. 2 is a cross-section of the device of FIG. 1, FIG. 3 is a cross-sectional end view of the locking section of the device of FIG. 1, and FIG. 4 is another side view of the device of FIG. 1 shown secured on a shaft against a bobbin supplying wire in a braiding machine.

DESCRIPTION OF THE PREFERRED EMBODIMENT

As shown in FIGS. 1, 2 and 3, the adjustable tensioning and locking device 10 includes a locking section having a first outer cylinder 12 enclosing a first spring 14 at one end and an inner cylinder 16 extending through cylinder 12 and out of the end. A disc 18 is secured by a press fit to the outer end of cylinder 16. Spring 14 fits around inner cylinder 16 and within outer cylinder 12 and is held between the transverse end 20 of cylinder 12 and an annular ridge 22 on cylinder 16. The other end of cylinder 12 is press fit into the outer recessed portion 24 of a countersunk hole 26 in a first ring-shaped bushing 28. A thin wedged ring 30 fits around the other end of inner cylinder 16 within outer cylinder 12 and extends to the other side of ridge 22.

Cylinder 16 includes four holes 32 positioned adjacent ridge 22 which holes accomodate respective ball bearings 34. Ring 30 includes an inner tapered diameter or wedged portion 36 which fits around the ball bearings. The bearings extend through the thickness of cylinder 16 and into the hollow tubular space 38 which is adapted to receive a shaft, as will be more fully described hereinafter. The thickness of cylinder 16 between ridge 22 and the inner end adjacent the bushing 28 is preferably somewhat larger than the other end portion to hold the bearings which protrude slightly above and below the cylinder wall. Cylinder 16 is slidable within cylinder 12, with ridge 22 and transverse end 20 providing a close fit between the two. Spring 14 is normally compressed between the ridge and transverse end as indicated and holds the inner cylinder in the position shown at the end of cylinder 12 adjacent bushing 28. In order to move cylinder 16 outwardly from cylinder 12 it is necessary to manually push disc 18 out. This further compresses spring 14 so that cylinder 16 returns to the normal position when released.

Bushing 28 fits closely and is slidable within a second larger outer cylinder 40 of a tensioning section. A second larger spring 42 has one end press fit into an inner countersunk portion 44 on the opposite side of bushing 28. The other end of the spring is press fit into another countersunk portion or recess 46 of a second bushing 48 which is press fit into the other end of cylinder 40. An outer recess or countersunk portion 50 of bushing 48 receives a fibrous pad 52 which serves as a friction element when engaging the end of a rotatable wire supply bobbin. Pad 52, bushing 48 and spring 42 have inner diameters approximately equal to that of bushing 28 and inner cylinder 16 to receive a shaft which passes through the entire assembly 10.

A typical mechanism utilizing the present tensioning and locking device is shown in FIG. 4 wherein a wire supply bobbin 54 of a wire braiding machine is rotatably mounted on a fixed shaft 56 held by a support structure 58 including a wire guiding pulley 60 and rollers 62, 64 which feed a plurality of wire strands 66 toward a braiding device, not shown. In operation, the tensioning and locking device 10 is positioned on shaft 56 with pad 52 and cylinder 40 at the lower end and moved along the shaft toward the top end 68 of bobbin 54. As soon as the shaft engages ball bearings 34 protruding into hollow tubular space 38, the bearings become wedged between the shaft and the tapered portion 36 of ring 30, which in turn bears against the inner surface of cylinder 12, with spring 14 holding the elements in position.

At this point no further downward movement is possible and the device 10 is locked in position on the shaft, until disc 18 and cylinder 16 are manually moved upwardly from cylinder 12 against the tension of spring 14 to release the bearings from the shaft and wedged ring 30. With cylinder 16 maintained in the released position held outwardly from cylinder 12 the device 10 may then be moved downwardly along the shaft until pad 52 contacts the outer end 68 of bobbin 54. In order to apply a desired increased adjustable pressure on pad 52 and corresponding friction force against the end of the bobbin, the locking section including cylinders 12 and 16 and bushing 28 are pushed further down into outer cylinder 40 with spring 42 being compressed further to apply additional force against the pad through bushing 48 fixed at the end of cylinder 40.

Upon removal of manual pressure holding cylinder 16 out of cylinder 12, spring 14 causes the cylinders to return to the normal position, ball bearings 34 engage shaft 56 at the selected position and also engage wedged ring 30 which is forced against cylinder 12 to lock device 10 in place. The extent to which cylinder 12 and slidable bushing 28 penetrate within outer cylinder 40 thus determines the pressure of spring 42 against bushing 48 and pad 52 and the friction force against the end 68 of rotating bobbin 54. This in turn determines the tension in wires 66 being pulled by the braiding machine. The selected fixed position of the tensioning and locking device 10 on the shaft thus maintains a steady tension in the wires drawn from the bobbin and the tension is adjustable by moving the locking cylinder section to another position up or down the shaft within tensioning cylinder section 40. The applied tension is removed by again moving cylinder 16 outwardly from cylinder 12 to release the locking section and move device 10 and friction pad 52 away from the bobbin upwardly along the shaft.

The present invention thus provides a simplified improved adjustable tensioning device which can be manipulated and positioned on a shaft with only one hand while the other hand can be used to hold and guide the wire strands from the bobbin. The device has been successfully used in conjunction with a Wardwell Braiding Machine manufactured by the Wardwell Company and has resulted in the elimination of several components including a spindle and sleeve which are replaced by the fixed shaft, a lower cup supporting the bobbin, a safety pin, a spool bearing, a pawl arm and a spring previously employed to apply tension. Typical dimensions of the device may be about 3.5 inches in length for the overall assembly and about 1.5 inches in diameter for the largest cylinder, with the device fitting onto a $\frac{5}{8}$ inch diameter shaft. While only a single embodiment has been illustrated and described, it is apparent that many variations may be made in the particular design, configuration and application without departing from the scope of the invention as set forth in the appended claims.

What is claimed is:

1. An adjustable tensioning device comprising:

a first outer cylinder including a fixed ring shaped bushing within one end and a slidable ring shaped bushing within the other end, a first spring having respective ends secured between said bushings and extending longitudinally within said outer cylinder, a friction pad extending outwardly from the one end of said first cylinder and fixed bushing;

a second smaller diameter outer cylinder having one end fixedly secured to said slidable bushing for axial movement into the other end of said first cylinder and extending outwardly from said first cylinder;

an inner cylinder having one end extending and slidable within said second cylinder and the other end extending outwardly from said second cylinder, an annular ring around the outer periphery of said inner cylinder at an intermediate longitudinal position between the opposite ends and enclosed within said second cylinder, a second spring positioned longitudinally about said inner cylinder and within said second cylinder between said annular ring and the other end of said second cylinder, said second spring normally biasing said inner cylinder toward said one end of said second cylinder, a wedged ring positioned longitudinally about said inner cylinder and within said second cylinder between said annular ring and the one end of said second cylinder, said inner cylinder including a plurality of holes about the peripheral walls adjacent said wedged ring, a plurality of rotatable bearings positioned in respective said holes, said bearings extending radially inwardly and outwardly from said walls, said inner cylinder and fixed and slidable bushings and first spring and friction pad having a hollow central tubular area to receive a longitudinal shaft therethrough, and means at the other end of said inner cylinder for manually moving said inner cylinder outwardly from said second cylinder.

2. The device of claim 1, wherein said bearings and wedged ring are adapted to lock said inner and second cylinders in a selected position on said shaft, said second spring normally holding said wedged ring and bearings in the locked position and permitting release upon manual movement of said inner cylinder outwardly.

3. The device of claim 2, wherein said friction pad at said one end of said first cylinder is adapted to engage an end surface of a rotatable element mounted on said shaft and wherein movement of said second cylinder into said first cylinder compresses said first spring to apply force against said fixed bushing and friction pad, the selected locked position of said inner and second cylinders on said shaft and within said first cylinder determining the force on said first spring and tension of said friction pad against said end of said rotatable element.

4. The device of claim 3, wherein said fixed and slidable bushings include annular recesses receiving the respective ends of said first spring, said slidable bushing having a further recess on an opposing face receiving said one end of said second cylinder.

5. The device of claim 4, wherein said annular ring is a ridge on the outer surface of said inner cylinder.

6. The device of claim 5 wherein said wedged ring includes an inner tapered surface adapted to engage said bearings.

7. The device of claim 6, wherein said means for manually moving said inner cylinder is an annular disc.

* * * * *